US005119571A

United States Patent [19]

Beasley

[11] Patent Number: 5,119,571

[45] Date of Patent: Jun. 9, 1992

[54] DEHYDRATION APPARATUS AND PROCESS OF DEHYDRATION

[76] Inventor: Richard Beasley, County Rd. 4137 16075, Lindale, Tex. 75771

[21] Appl. No.: 561,675

[22] Filed: Aug. 1, 1990

[51] Int. Cl.[5] ..... F26B 3/00

[52] U.S. Cl. ..... 34/26; 34/32; 34/46; 34/77; 34/86

[58] Field of Search ..... 34/26, 32, 46, 48, 50, 34/66, 72-78, 212, 83

[56] References Cited

U.S. PATENT DOCUMENTS

| | | | |
|---|---|---|---|
| 3,831,294 | 8/1974 | Freze | 34/77 |
| 3,931,683 | 1/1976 | Crites et al. | 34/73 |
| 4,241,515 | 12/1980 | Wochnowski et al. | 34/46 |
| 4,250,629 | 2/1981 | Lewis | 34/77 |
| 4,447,965 | 5/1984 | Bray | 34/77 |
| 4,469,720 | 9/1984 | Morris | 34/73 |
| 4,644,666 | 2/1987 | Eberle et al. | 34/77 |

*Primary Examiner*—James C. Yeung
*Attorney, Agent, or Firm*—Ronald B. Sefrna

[57] ABSTRACT

The present invention provides an apparatus particularly useful for the dehydration of organic materials, and a process of dehydration using the apparatus of the invention. The apparatus includes a drying enclosure to receive and contain materials to be dehydrated, a cooling section with a first stage cooling coil and a second stage cooling coil to remove moisture from a drying fluid by condensation, a heating section with a first stage heating source and a second stage heating source controllable for selecting the amount of heat output therefrom, to raise the temperature and lower the relative humidity of the drying fluid, and a drying fluid handling system to convey the drying fluid in a closed loop through the sections of the apparatus. The process of the invention includes the general steps of heating a drying fluid, passing the drying fluid over the material to be dried, cooling the drying fluid to condense moisture, heating the drying fluid to elevate its temperature and reduce its relative humidity, and reintroducing the heated drying fluid to the process loop to be recirculated though the apparatus until the desired degree of dehydration has been achieved.

2 Claims, 5 Drawing Sheets

DEHYDRATION APPARATUS AND PROCESS OF DEHYDRATION

FIELD OF THE INVENTION

The present invention generally relates to dehydration apparatus and to dehydration processes, and more particularly relates to dehydration apparatus particularly useful for drying flowers and other plant materials, and to a dehydration process wherein a volume of warm dry air is recirculated through the plant material, moisture is removed from the air by cooling and condensation, and the air is reheated prior to reintroduction to a drying chamber.

BACKGROUND OF THE INVENTION

The use of dehydration or drying processes to reduce or adjust the moisture content of, especially, organic materials has been practiced for many years. The purposes of dehydration have included the preservation of food products, the curing of wood and other construction materials, the drying of clothing and other fabrics, and the preservation of flowers and other decorative plant materials. In the original and most basic forms, dehydration is achieved by handing the materials to be dried on a simple rack and exposing them to sunlight, but the dependence of that approach on uncontrollable environmental factors creates significant disadvantages and has lead to the development of more sophisticated approaches, including the circulation of air in an enclosure containing the materials to be dried.

In one air circulation approach to dehydration, warmed air is circulated through the materials to be dried to remove moisture, and is then exhausted from the system, as generally illustrated by U.S. Pat. No. 4,241,515 to Wochnowski et al., which discloses a method and apparatus for conditioning tobacco. This approach represents an improvement over the use of ambient air for drying, but does not provide any means for dehumidification of the air used for drying and thus does not allow independent control of both air temperature and moisture content.

U.S. Pat. No. 4,447,965 to Bray discloses a drying process and apparatus which dehumidifies a vapor laden effluent by condensing the vapor through acceleration of the effluent stream in a venturi-type device. The dried air, or other drying fluid, is then compressed, heated, and recirculated. This approach is generally effective for moisture removal, but is subject to several significant limitations and disadvantages. Proper operation of the venturi-type device requires that parameters such as air flow, pressure, and temperature be maintained within narrow ranges, and the apparatus is necessarily designed without any means of independent control of those, and other parameters. As a result, this approach cannot be effectively used when it is necessary or desirable to vary the conditions of the stream of air through the dehydration apparatus.

U.S. Pat. No. 4,250,629 to Lewis illustrates an approach In another approach to dehydration moisture laden air is passed over cooling coils to condense and remove moisture from the air stream, as illustrated by U.S. Pat. Nos. 4,250,629 to Lewis and 3,931,683 to Crites, et al. In the Lewis and Crites examples the air is then heated and circulated around the material to be dried. The apparatus disclosed by both examples utilize a compression-type refrigeration system with evaporator coils and condenser coils to respectively cool and heat the air stream. The Lewis apparatus is specifically intended for use as a lumber conditioning kiln, and the Crites apparatus is intended for drying granular-type materials such as cereal grains. The Lewis apparatus requires the inclusion of a by-pass air passage to recirculate air without passing over the cooling coils or heating coils in certain circumstances, for the primary purpose of controlling the operating parameters of the refrigeration system rather than precisely controlling the parameters of the stream of air passing over the lumber to be dried. The lack of precise control drying air conditions does not present a problem for the conditioning of lumber, but is a serious disadvantage for the dehydration of more delicate materials, such as flowers. The Crites system provides direct contact between the material to be dried and the heat exchange surfaces of the heating coils, an approach which is efficient for the drying of grains but unsuitable for delicate materials, and does not provide for precise control of either the temperature or the humidity of the air stream.

There remains a need for a dehydration apparatus and process that allows precise and efficient control of the parameters of the stream of air or other drying fluid, such as temperature, humidity, and velocity, during the dehydration operation. There is also a need for a dehydration apparatus and process which allows those parameters to be varied during the dehydration operation as needed for optimal efficiency and product quality.

SUMMARY OF THE INVENTION

The present invention provides both a dehydration apparatus and a process of dehydration designed to allow rapid and efficient dehydration of organic materials under precisely monitored and controlled conditions to produce dried materials of high and consistent quality. The apparatus of the invention generally comprises the basic component sections of, a drying enclosure to contain the materials to be dried, a condensing section for removal of moisture from a stream of drying fluid passed over the materials to be dried, a heating section for heating the stream of drying fluid prior to introduction into the drying enclosure, and a looped duct system connecting the drying enclosure, the condensing section, and the heating section to contain and circulate the drying fluid between and through the component sections of the apparatus. The apparatus further includes a monitoring and control section, comprising various temperature sensors and humidity sensors, and control valves and the like appropriately disposed through the operational sections so as to allow process conditions to be continuously monitored and controlled for optimum process performance.

The basic steps of the process of the invention generally comprise placing materials to be dried in the drying enclosure; heating a volume of air or other drying fluid to a preselected temperature; introducing the heated air to the drying enclosure containing materials to be dried; drawing the heated air over, through, and around the materials in the drying enclosure, whereupon the air absorbs moisture from those materials; withdrawing the moisture laden air from the drying chamber; introducing the moisture laden air to the condensing section where it is cooled to condense and remove the moisture; and returning the cooled and dried air to the heating section of the apparatus to reenter the process loop. The drying air is recirculated through the process loop without venting or addition of make-up air during the operation of the process of the invention.

In the preferred embodiment of the invention, described in more detail below, the drying enclosure is a room-like enclosure having a base, a perforated floor raised a short distance above the base, four side walls, and a peaked roof. Drying air is introduced into the drying enclosure between the base and the floor and rises through the drying enclosure to the peak of the roof. Drying air at the peak of the drying enclosure is split into a first return air stream and a second return air stream, which are separately conveyed to the condensing section of the apparatus. The condensing section of the apparatus preferably includes a first stage evaporator coil of a compression-type refrigeration system, and a second stage evaporator coil. The first return air stream is passed over the first stage evaporator coil, is then mixed with the second return air stream, and the combined air streams are passed over the second stage evaporator coil for condensation and removal of moisture. The heating section of the apparatus includes a plurality of independently controlled electrical heating elements or other heat sources, so as to allow precise control of the amount of heat added to the circulating stream of drying fluid. Drying air exiting the condensing section of the apparatus is passed through the heating section of the apparatus, over the heat sources, raising its temperature and reducing its relative humidity. The drying air is then conveyed through the duct system of the apparatus to the drying enclosure and recirculated through the apparatus. The circulation of drying air in the process loop through the apparatus is continued until the moisture content of the materials to be dried is reduced to the desired level. The circulation is then stopped and the dried materials are removed from the drying enclosure.

In the preferred embodiment the process operation is closely monitored with a combination of temperature sensors and relatively humidity sensors disposed at certain strategic locations within the apparatus. The operation and progress of the process may be manually monitored and controlled, or the temperature and humidity sensor output may be input to a programmable electronic controller such as a personal computer or the like for automatic control.

The process of the invention is particularly useful for drying flowers and other delicate organic materials subject to rapid degradation or spoilage, such as fruits and vegetables, but may also be beneficially used for the drying of almost any type of material when the ability to precisely monitor and control process conditions and/or final moisture content is desired or necessary. The rate of drying and the final moisture content of the dried materials can be monitored by various receptor devices and immediately adjusted by controlling temperatures and relative humidities in order to achieve optimum process conditions for specific applications.

Recirculation of the drying air in the closed process loop has been found to be beneficial in the drying of many flower varieties, especially those containing relatively large amounts of compounds with low solubility in water. It is believed that as the drying proceeds the concentration of such compounds in the recirculating air increases toward an equilibrium point and the rate of evaporation of such compounds from the flowers is reduced, leaving a higher concentration in the final product. Depending on the compounds involved, the result may be improved fragrance, improved color, and/or reduced brittleness in comparison to flowers dried by other processes.

Furthermore, the condensate removed from the process loop in the condensing section of the apparatus may be further processed to recover useful water soluble compounds removed from the materials during the drying operation. For example, when the process is used for drying flowers the condensate contains aromatic compounds which may be recovered for use in the fragrance industry.

The preferred and alternative embodiments of the apparatus of the invention and of the process of the invention, as well as these and other features and advantages thereof, will be described in detail with reference to the accompanying drawing figures.

DETAILED DESCRIPTION OF THE INVENTION

Figure 1:
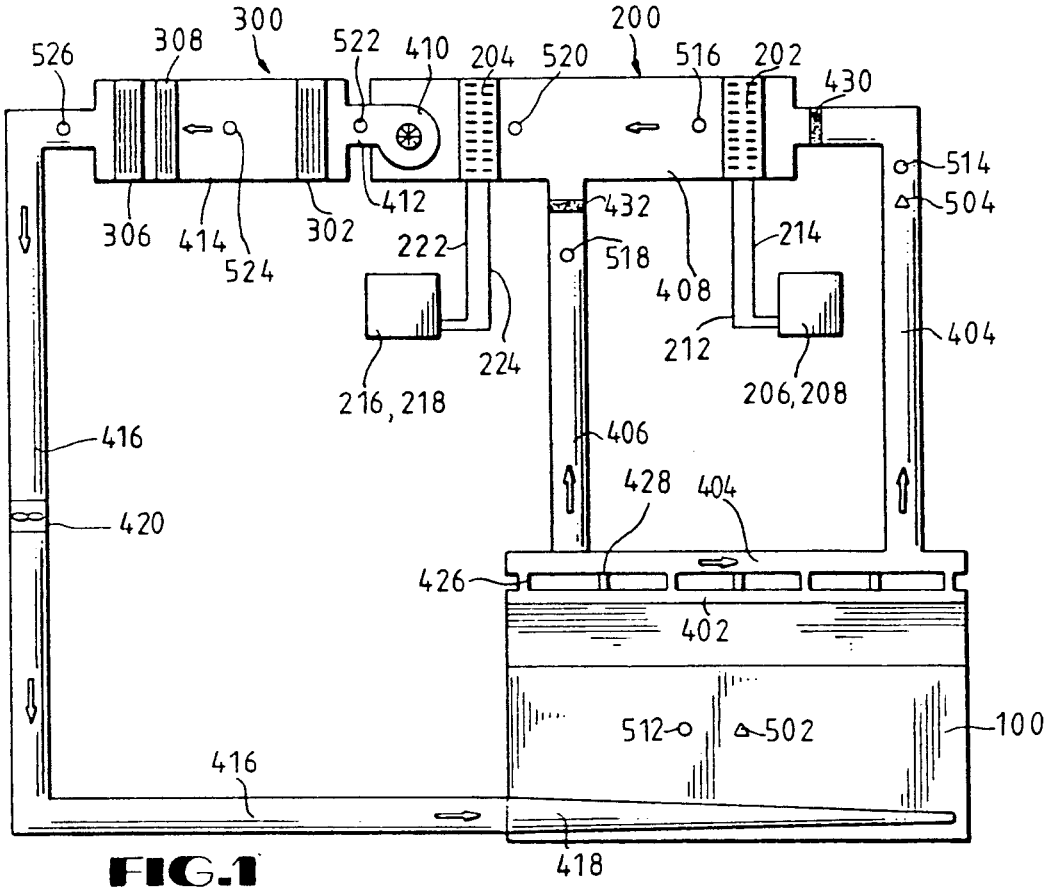
FIG. 1 is a schematic illustration of the preferred embodiment of the apparatus of the invention, also illustrating the flow of drying fluid in the preferred embodiment of the process of the invention.
Figure 4:
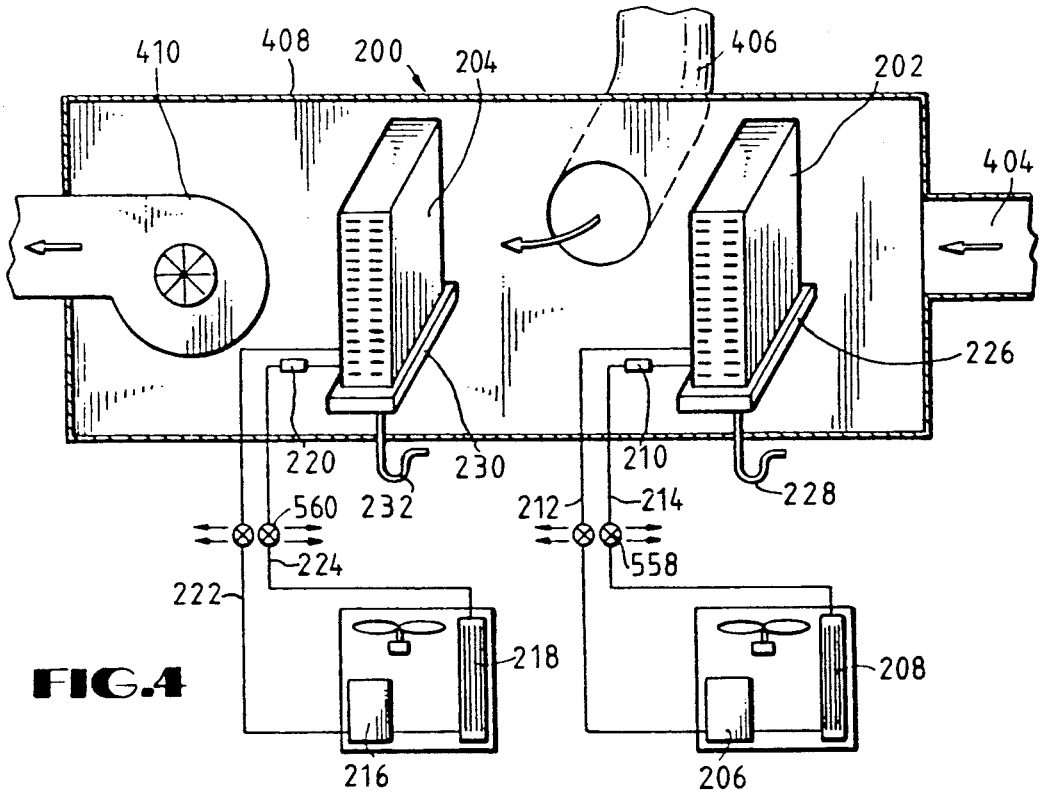
FIG. 4 is a schematic illustration of the condensing section of the preferred embodiment of the apparatus of the invention.
Figure 6:
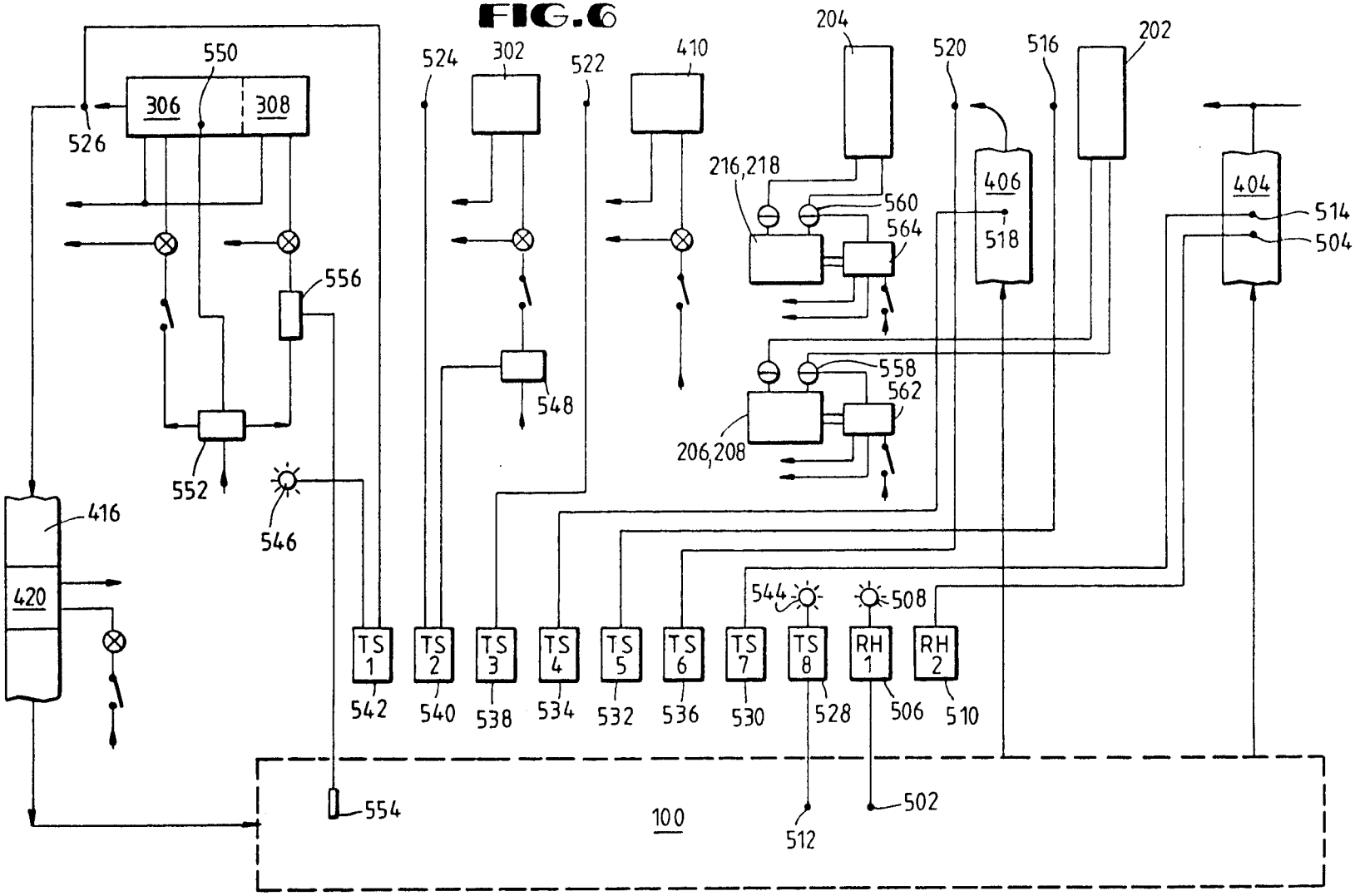
FIG. 6 a schematic diagram of the monitoring and control system of the preferred embodiment of the apparatus of the invention.

The apparatus of the invention may be conceptually divided into several discrete but interactive operational sections, schematically illustrated in FIG. 1, including drying enclosure 100, condensing section 200, heating section 300, and an air handling system designated by reference numbers in the 400 series. In addition, the apparatus of the invention includes a monitoring and control system designated by reference numbers in the 500 series, the preferred embodiment of which is schematically illustrated in FIG. 6. The preferred embodiment of each of the primary operational sections or systems will be described with reference to the drawing figures, and then the preferred embodiment of the process of the invention will be described in terms of the flow of drying fluid through the component segments and in terms of the monitoring and control of process variables to be achieved through the interactive operation of the monitoring and control system.

Figure 2:
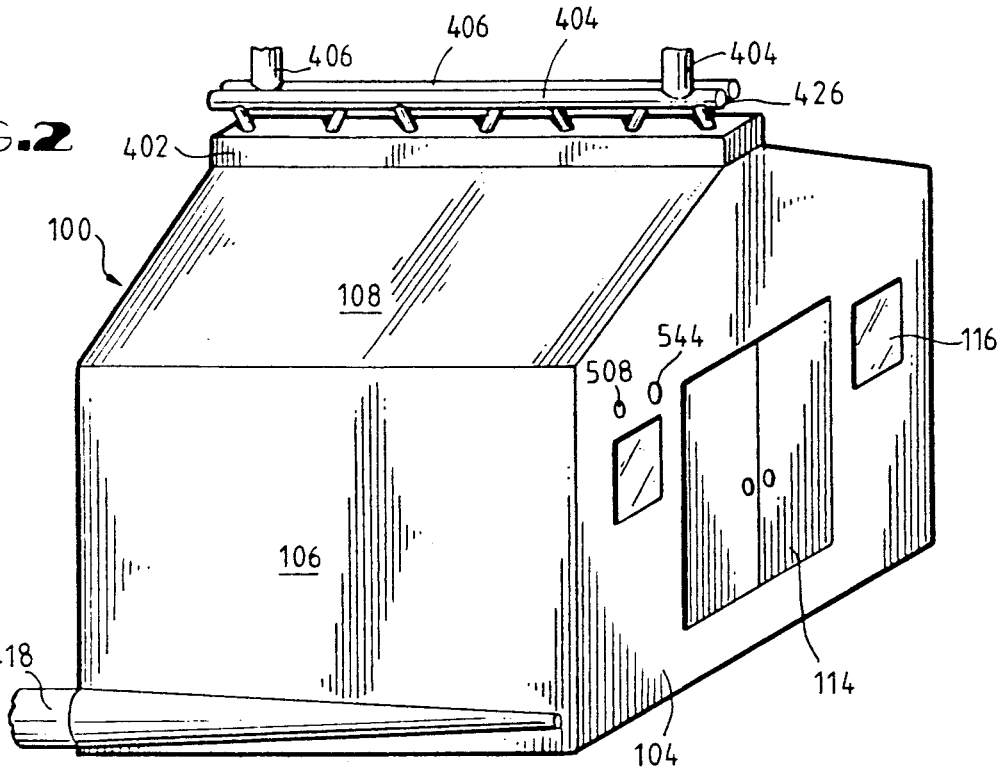
FIG. 2 is a perspective view of the preferred embodiment of the drying enclosure of the apparatus of the invention.
Figure 3:
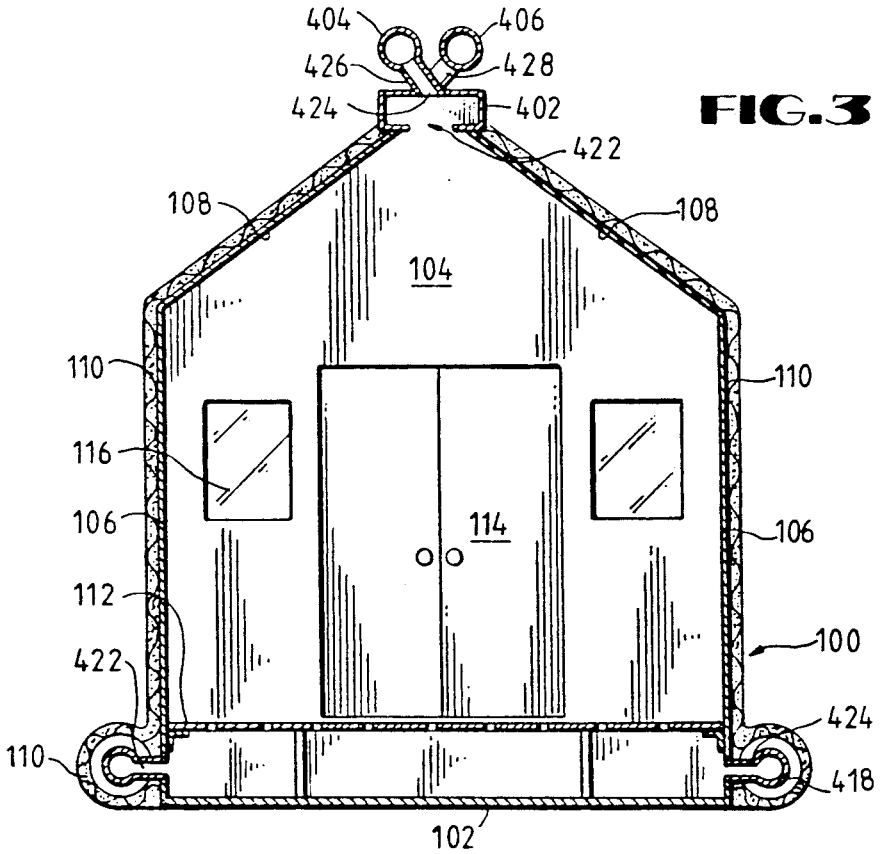
FIG. 3 is a sectional elevation view of the preferred embodiment of the drying enclosure of the apparatus of the invention, along line 3—3 of FIG. 2.
Figure 5:
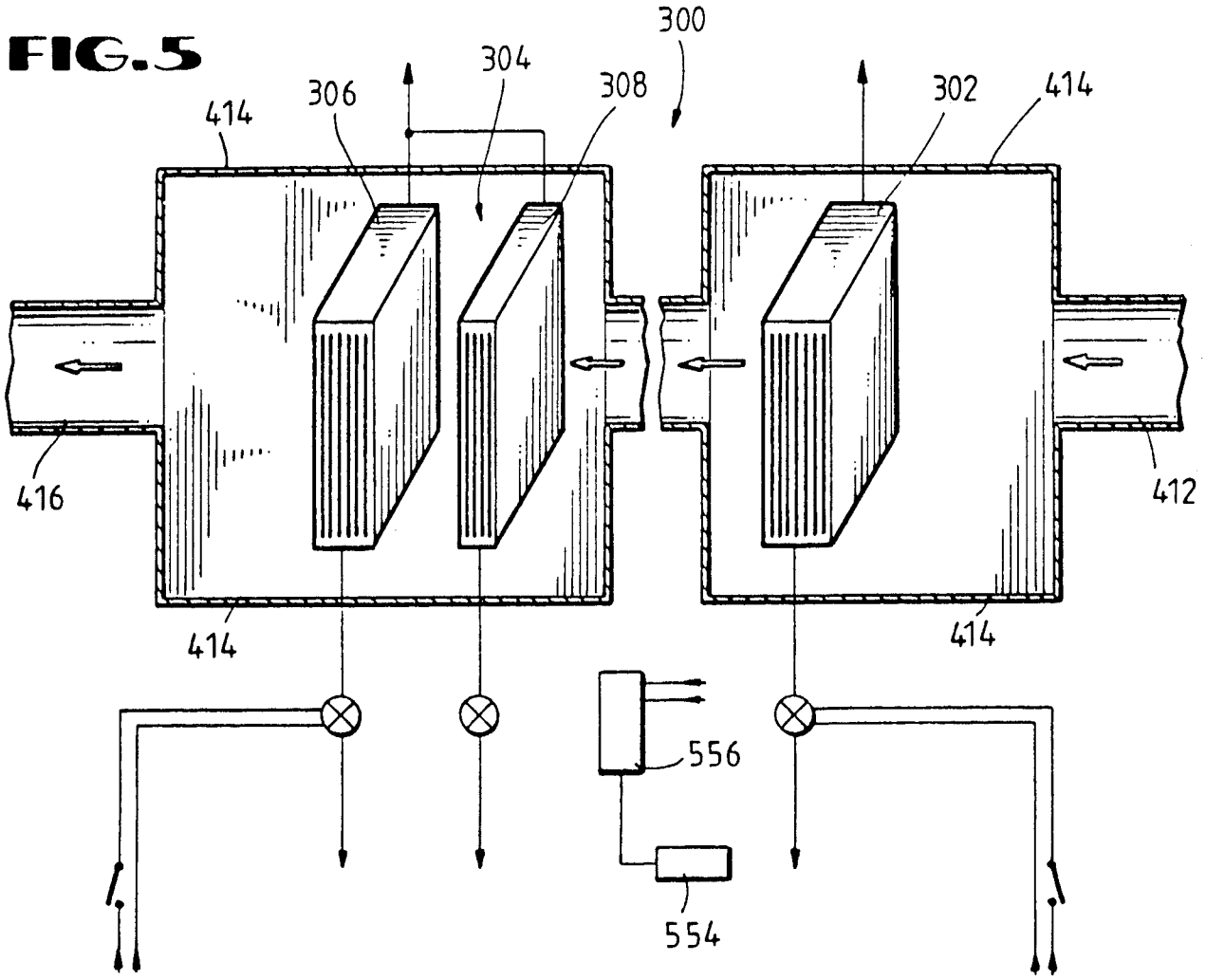
FIG. 5 is a schematic illustration of the heating section of the preferred embodiment of the apparatus of the invention.

Referring now to FIGS. 2 and 3, the preferred embodiment of drying enclosure will be seen to comprise a voluminous hollow enclosure having a generally rectangular base 102, a pair of opposed substantially planar end walls 104, a pair of opposed substantially planar side walls 106, and a roof 108, all interconnected so as to form a room-like enclosure. The interconnections between base 102, end walls 104, and side walls 106, and the inconnections between end walls 104, side walls 106, and roof 108 are air-tight, to prohibit egress of drying fluid and/or ingress of atmospheric air during operation of the apparatus of the invention. It is further preferred that each of base 102, end walls 104, side walls 106, and roof 108 be covered by insulation 110, to restrict the transfer of heat from the enterior of drying enclosure 100 during operation of the apparatus. Insulation 110 may be of any convenient type and composition suitable for the operating conditions to be encountered, though it is preferred that the insulating value of insulation 110 be at least R-22.

In the preferred embodiment of the apparatus of the invention, drying enclosure 100 is provided with floor 112, suspended a short distance above base 102 in the interior of drying enclosure 100. Floor 112 is perforated, to allow drying fluid introduced into the space between base 102 and floor 112 to be distributed through such space and flow through the perforations in floor 112 toward roof 108 in an evenly distributed manner. Although the use of perforated floor 112 is preferred, drying fluid may be introduced into the interior of drying enclosure 102 through a plurality of grills disposed in side walls 106 near their interconnection to base 102, so long as a properly distributed and generally laminar flow of drying fluid toward roof 108 is achieved.

Roof 108 of the preferred embodiment of drying enclosure 100 is formed as a peaked roof, sloping upwardly a generally center peak from the interconnection of each side wall 106 with roof 108. The sloping configuration of roof 108 causes drying fluid flowing upwardly through the interior of drying enclosure 100 to flow along the sloping inner surfaces of roof 108 to the peak thereof, where the drying fluid may be conveniently collected for distribution through other component sections of the apparatus of the invention. In the preferred embodiment of the apparatus of the invention, each sloped segment of roof 108 is included at an angle of approximately 10 degrees to 20 degrees above a horizontal plane extending between the upper edges of side walls 106. Although drying enclosure 100 is described as having a sloping roof 108, it will be understood that the enclosure could be constructed with an outer roof and an inner sloped ceiling 108, if desired.

Drying enclosure 100 also includes doors 114, preferably disposed in one of end walls 104, for access to the interior of drying enclosure 100 to load materials to be dried and remove final product therefrom. Doors 114 must form an air-tight seal when closed, and are provided with insulation 110 to limit heat transfer therethrough. Drying enclosure 100 may also be provided with viewing windows 116 if desired, to allow visual inspection of the interior thereof, but the number and size of windows 116 should be reasonably limited to limit loss of heat from the interior of drying enclosure, and the penetrations through end walls 104 and/or side walls 106 in which windows 116 are interconnected should be sealed against air flow.

It should be understood that while the configuration described above is preferred and has been found to be highly efficient, drying enclosure 100 could be formed in various alternative configurations without departing from the scope of the invention, so long as the proper flow of drying fluid therethrough, as described below, is maintained. For example, base 102 could be circular with a continuous annular side wall replacing end walls 104 and side walls 106 and with roof 108 of frustoconical configuration, or base 102 could be of polygonal configuration.

Condensing section 200 of the apparatus of the invention includes at least one cooling coil, for the purpose of absorbing sufficient heat from moisture laden drying fluid directed over such coil (s) to condense a substantial portion of such moisture and thus remove it from the drying fluid. In its preferred embodiment, condensing section 200 includes a first stage cooling coil 202 and a second stage cooling coil 204. In the preferred embodiment of the apparatus, each cooling coils 202 and 204 is the evaporation coil of a conventional compression-type refrigeration system. Accordingly, cooling coil 202 is associated with a refrigerant compressor 206, refrigerant condensing coil 208, expansion valve 210, low pressure refrigerant conduit 212, and high pressure refrigerant conduit 214; and likewise, cooling coil 204 is associated with a compressor 216, condensing coil 218, expansion valve 220, low presssure conduit 222, and high pressure conduit 224. Cooling coil 202 is provided with condensate collection pan 226, to catch moisture condensed from the moisture laden stream of drying fluid, and with condensate conduit 228 for removal of condensate from collection pan 226, and cooling coil 204 is provided with condensate collection pan 230 and condensate conduit 232. In the preferred embodiment of the apparatus of the invention, second stage cooling coil 204 ois of greater cooling capacity than first stage cooling coil 202, with cooling coil 204 providing approximately 60 to 65 percent of the total cooling capacity. In the context of condensing section 200, it should be understood that while the use of conventional refrigeration systems as described is preferred, any convenient means may be used to reduce the temperature of cooling coils 202 and 204 so as to condense a sufficient proportion of the moisture contained in the drying fluid passing over such coils for proper operation of the process of the invention.

Heat section 300 of the apparatus of the invention includes a plurality of heating coils to be disposed in the flow path of the drying fluid following removal of moisture in condensing section 200, for the purpose of elevating the temperature and reducing the relative humidity of the drying fluid during operation of the apparatus. In the preferred embodiment of the apparatus of the invnetion, heating section 300 includes a first stage heat source 302 and a second stage heat source 304, physically separated a short distance in the apparatus to allow mixing and expansion of the drying fluid between the two sources. It is preferred, for most efficient operation of the apparatus, that first stage heat source 302 operate continuously while the overall apparatus is in operation. In its preferred embodiment, second stage heat source 304 includes a continuously operating portion 306 and an serlectively operating 308. It has been found that the division of the continuously operating heat sources into physically separated heat sources 302 and 306 is more efficient than the use of a single source to add the same total amount of heat to the drying fluid, in that the expansion and mixing of the drying fluid in the space between heat sources 302 and 306 allows more homogenous heat exchange as the drying fluid passes over heat source 306. It is preferred that the heat sources of heating section 300 be of the electrical resistance type, in order to allow precise control of the amount of heat available from each of the component sources described, but it will be understood that a wide range of heat sources may be utilized in alternative embodiments within the scope of the invention.

Air handling section 400 generally includes ducts and blowers for collecting and conveying drying fluid through the apparatus of the inveniton in a closed loop. With reference to FIG. 1, and beginning at the peak of drying enclosure 100, air handling system 400 more specifically comprises the major components of, air collector 402, first stage return air duct 404, second stage return air duct 406, condensing section plenum 408, main blower 410, inter-sectional duct 412, heating section plenum 414, heat air duct 416, and drying enclosure supply ducts 418. The air handling section may also include one or more variable speed in-line duct fans 420, if desired. It is preferred that main blower 410 be provided with a variable speed motor, for control of the flow rate of drying fluid through the loop of the apparatus, making the inclusion of duct fans 420 unnecessary. However, if main blower 410 is provided with a fixed speed motor the use of ducts fans 420 provides a means for precise control of drying fluid flow. It will be understoood that the interior of drying enclosure 100 functions as an integral part of air handling section 400, as drying fluid is drawn through the interior of drying enclosure 100 during the circulation of drying fluid through the closed loop of the apparatus of the invention.

In the preferred embodiment of the invention, air collector 402, depicted in FIG. 3, is of rectangular cross-sectional configuration, and is provided with elongate slot 422 extending along the major portion of the lower wall of air collector 402, to receive moisture laden drying fluid from the interior of drying enclosure 100. The upper wall of air collector 402, opposite the wall penetrated by elongate slot 422, is penetrated by a plurality of apertures 424 evenly spaced along the length of such upper wall, with each of apertures 424 feeding moisture laden drying fluid to first stage return air duct 404 and to second stage return air duct 406 through a plurality of first stage air nipples 426 and second stage air nipples 428, respectively. The number and size of apertures 424, first stage air nipples 426, and second stage air nipples 428 will vary with the total capacity of the apparatus of the invention, as will the size of the other components of air handling system 400, but the volume of drying fluid fed into and conveyed through first stage return air duct 404 is always greater than the volume of drying fluid fed into and conveyed through second state return air duct 406. In the preferred embodiment, approximately 55 percent to 65 percent of the total volume of drying fluid is fed into and conveyed through first stage return air duct 404. Both first stage return air duct 404 and second stage return air duct 406 are interconnected to cooling section plenum 408, and are preferably provided with in-line air filters 430 and 432 conveniently disposed in first stage return air duct 404 and second state return air duct 406, respectively.

Cooling section plenum 408 is formed as a conventional air handling plenum, of sufficient physical size to enclose first stage cooling coil 202, second stage cooling coil 204, and main blower 410, with suifficient space between the first and second stage cooling coils to allow a thorough mixing of drying fluid in such space. In the preferred embodimemt, cooling section plenum 408 is an elongate hollow body of rectangular cross-sectional configuration, having a first end and a second end, although it will be understood that any convenient configuration consistent with proper control of drying fluid flow may be utilized. First stage cooling coil 202 is disposed in the interior of cooling section plenum 408 near the first end thereof, and first stage return air duct 404 is interconnected to cooling section plenum 408 at its first end so that drying fluid introduced into plenum 408 from duct 404 passes over cooling coil 202. As the first stage drying fluid flows over cooling coil 202 the drying fluid is cooled, and moisture contained therein is condensed and removed from teh process loop through collection pan 226 and condensate conduit 228, so that the drying fluid exiting cooling coil 202 is relatively cool and dry. Second stage return air uct 406 is interconnected to cooling section plenum 408 intermediate its first and second ends, so that the portion of moisture laden drying fluid conveyed by duct 406 is introduced into plenum 408 just downstream toward the second end thereof from first stage cooling coil 202. The length of plenum 408 between the interconnection of duct 406 thereto and the second stage cooling coil 204 is sufficient to allow a mixing of the warm moist drying fluid introduced from duct 406 with the cool dry drying fluid exiting cooling coil 202 before the mixed stream of drying fluid is passed over cooling coil 204, disposed near the second end of plenum 408. As the two streams of drying fluid are mixed, the second stage stream of drying fluid is cooled to or near its dew point before contacting second stage cooling coil 204, and condensation of moisture from the mixed streams by cooling cool 204 is facilitated. Main blower 410 is disposed in cooling section plenum 408 at its second end, downstream from second stage cooling coil 204, and preferably comprises a conventional squirrel cage blower, with a variable speed, typically electric, motor.

The outlet of main blower 410 is connected to intersectional duct 412, disposed between the second end of condensing section plenum 408 and the first end of heating section plenum 414, so that dehumidified and cooled drying fluid exiting main blower 410 is conveyed directly to plenum 414. Plenum 414, similar to plenum 408, is preferably an elongate body of rectangular cross-sectional configuration, of sufficient length to contain first stage heat source 302 and second stage heat source 304 and provide an intervening space. Drying fluid entering heating stage plenum 414 is forced through first stage heat source 302 to elevate the temperature and reduce the relative humidity of the drying fluid. As the drying fluid flows through the space between first stage heat source 302 and second stage heat source 304 it is allowed to expand and mix to a homogenous temperature and relative humidity before passing through second stage heat source 304 to further elevate its temperature, and thus further reduce its relative humidity, to the level selected for operation of the process of the invention.

Heated air duct 416 is interconnected to the second end of heating section plenum 414 to convey the heated drying fluid to drying enclosure supply ducts 418, where it is injected into the space between base 102 and floor 112. In the preferred embodiment of the apparatus of the invention, two drying enclosure supply ducts are provided, one extending along the lower edge of each side wall 106, and heated air duct 416 splits into two equal legs, each of which is interconnected to one of the pair of drying enclosure supply ducts. One or more variable speed duct fans 420, if utilized, may be disposed in heated air duct 416 before it splits, or a duct fan 420 may be disposed in each leg of heated air duct 416 after it splits.

Each of drying enclosure supply ducts 418 is preferably formed as a hollow body of circular or other convenient cross-sectional configuration, reducing in cross-sectional area from its interconnection to heated air duct 416 at its first end to its closed second end. Each drying enclosure supply duct 418 is penetrated by a plurality of apertures 422, each surrounded by a supply nipple 424 interconnected to duct 418 in air tight relation and extending through one of side walls 106 of drying enclosure 100 to the space between base 102 and perforated floor 112. The reduction in cross-sectional area of each of ducts 418 in the direction of flow of drying fluid therethrough allows the drying fluid pressure in the interior of duct 418 to remain generally constant as drying fluid exits the interior of duct 418 through supply nipples 424. In the preferred embodiment of the apparatus of the invention, heating section plenum 414, heated air duct 416, and drying enclosure supply ducts 418 are insulated against loss of heat therefrom, as is drying enclosure 100. It is not necessary to insulate the components of air handling system 400 between drying enclosure 100 and heating section plenum 414, since the loss of heat from drying fluid conveyed through those components is actually beneficial to operation of the process.

The monitoring and control section of the apparatus of the invention, schematically illustrated in FIG. 6, comprises a plurality of temperature sensors and relative humidity sensors or humidistats, disposed generally as depicted in FIG. 1. Any conventional type of temperature sensors and humidity sensors capable of providing accurate readings may be utilized. The humidity sensors are preferably direct reading humidistats, but wet bulb thermometers may be used within the scope of the invention. In the preferred embodiment the apparatus is provided with two humidity sensors, humidity sensor 502 disposed in the interior of drying enclosure 100, and humidity sensor 504 disposed in first stage return air duct 404. Sensor 502 is operatively connected to controller 506, which is adapted to close an electrical contact and activate indicator 508 when the relative humidity of the drying fluid within drying enclosure 100 falls below a pre-selected level. In the preferred embodiment indicator 508 is a light disposed on the exterior of drying enclosure 100, and serves to provide a visual indication of low humidity level. Sensor 504 is operatively connected to a display unit 510, such as an analog dial or digital display, which may be mounted on a control panel for convenient access by an operator of the apparatus.

The temperature sensors included in the preferred embodiment of the apparatus of the invention comprise sensor 512 disposed in the interior of drying enclosure 100; sensor 514 disposed in first stage air return duct 404; sensor 516 disposed in cooling section plenum 408 immediately downstream from first stage cooling coil 202 before the interconnection drying fluid from second stage air return duct 406; sensor 518 disposed in second stage return air duct; sensor 520 disposed in cooling section plenum 408 immediately upstream from second stage cooling coil 204; sensor 522 disposed in inter-sectional duct 412; sensor 524 disposed in heating section plenum 414 between first stage heat source 302 and second stage heat source 304; and sensor 526 disposed in heated air duct 416. Each of temperature sensors 512 through 526 is operatively interconnected to a display unit, preferably mounted on a control panel for convenient viewing by an operator of the apparatus. The display units associated with sensors 512 through 526, designated by reference numbers 528, 530, 532, 534, 536, 538, 540, and 542, respectively, and depicted in FIG. 6, provide a direct reading of temperature in each of the monitored locations. The temperature readings monitored at the specified locations enable an operator to evaluate process conditions existing in the apparatus at any given time, and to make operating adjustments as needed to control the process conditions as required for proper operation. In addition to the visual displays provided by display units 528 through 542, unit 528 associated with temperature sensor 512 in drying enclosure 100 and unit 542 associated with temperature sensor 526 in heated air duct 416 are adapted to activate visual indicators 544 and 546, respectively, to provide a visual alarm if the temperature at either monitored location rises above and/or falls below a pre-selected value. The visual indicators may be disposed in any convenient location, such as a control panel, though it is preferred that indicator 544 be provided as a light on the exterior of drying enclosure 100 with indicator 508, at least in addition to any control panel visual alarm.

Prevention of excessive temperatures is important to the processing of many materials which may be dried by the apparatus of the invention, and the preferred embodiment of the invention provides automatic controls for independently shutting down either or both continuous heat sources 302 and 306. Unit 540 associated with temperature sensor 524 disposed immediately downstream of first stage heat source 302 is adapted to interrupt the electrical power supplied to heat source 302 by activating automatic controller 548 if the temperature monitored by sensor 524 rises above a pre-selected level. Additional temperature sensor 550 is disposed in heat source 306 of second stage heat source 304, and is operatively connected to automatic controller 552 which is adapted to interrupt the electrical power to second stage heat source 304 if the temperature monitored by sensor 550 rises above a pre-selected level. Selectively operating portion 308 of second stage heat source 304 is thermostatically controlled, through a control system including temperature sensor 554, disposed in the interior of drying enclosure 100, and switch means 556. As shown in FIG. 6, if automatic controller 552 is activated, the electrical power supplied to heating source 308 is interrupted independently of the operation of switch means 556.

The monitoring and control section of the preferred embodiment of the apparatus of the invention further includes means of shutting down the refrigeration units associated with first and second stage cooling coils 202 and 204 to prevent damage to those units in the event of malfunction. Pressure sensors 558 and 560 and provided in the high pressure refrigerant lines of the first stage and second stage refrigeration units, respectively, and are connected to controller units 562 and 564, respectively. In the event that the pressure in either or both of the high pressure refrigerant lines falls outside a pre-selected range, the respective controller unit or units are activated to interrupt electrical power to the refrigerant units. The automatic controller units described above may, if desired, be interconnected, so that a shutdown of any of the controlled components automatically activates a shutdown of all controlled components of the apparatus.

Although the preferred embodiment of the invention disclosed herein is adapted for manual control in response to temperature and humidity readings, the monitoring and control system of the apparatus of the invention is readily susceptible to fully automatic operation. Each sensor input may be input to an electronic processor unit which is programmed to send output signals to automatically adjust, e.g., main blower 410, duct fans 420, and heating source 308.

Figure 7:
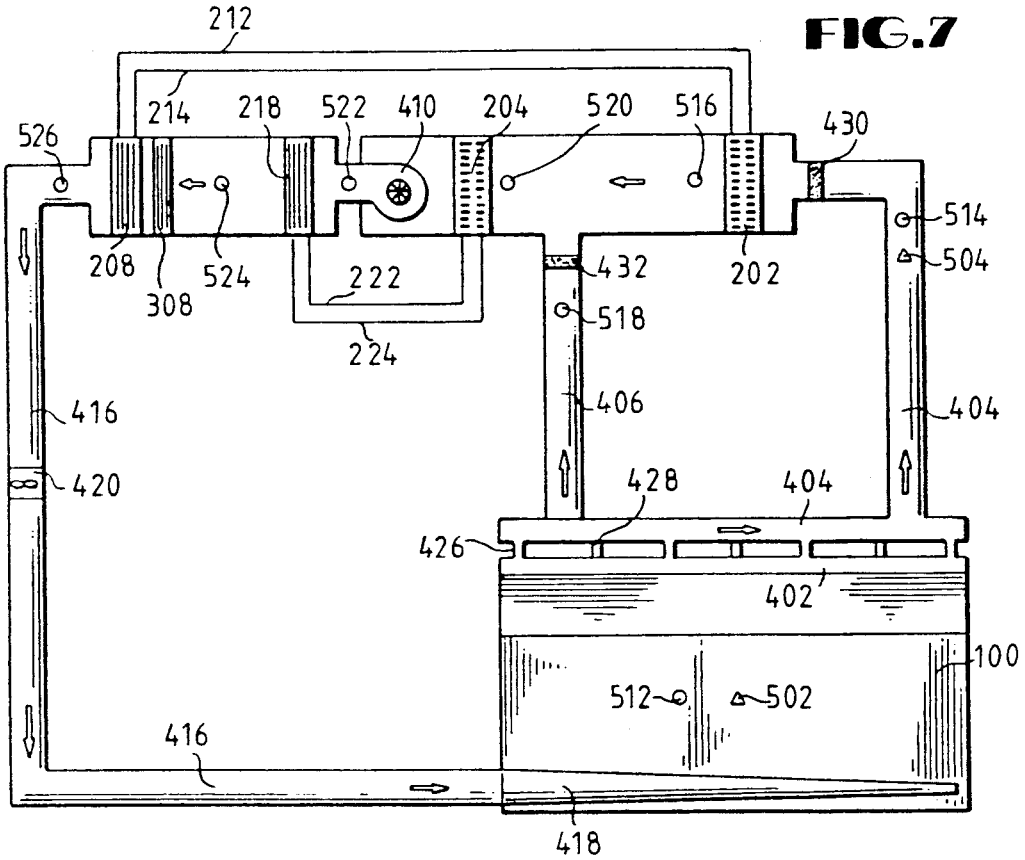
FIG. 7 is a schematic illustration of a first alternative embodiment of the apparatus of the invention.

The apparatus of the invention is also readily susceptible to various alternative embodiments. In a first alternative embodiment, schematically illustrated in FIG. 7, heating sources 302 and 306 are omitted, and the condensing coils 218 and 208 of the refrigeration units disposed in heating plenum 414. As drying fluid is passed over the condensing coils heat is transferred from the refrigerant flowing through the coils to the drying fluid. It is preferred that controllable heat source 308 be retained, in order to provide means for precisely controlling the heat added to the drying fluid, and thus the temperature of the drying fluid, in heating section 300.

Figure 8:
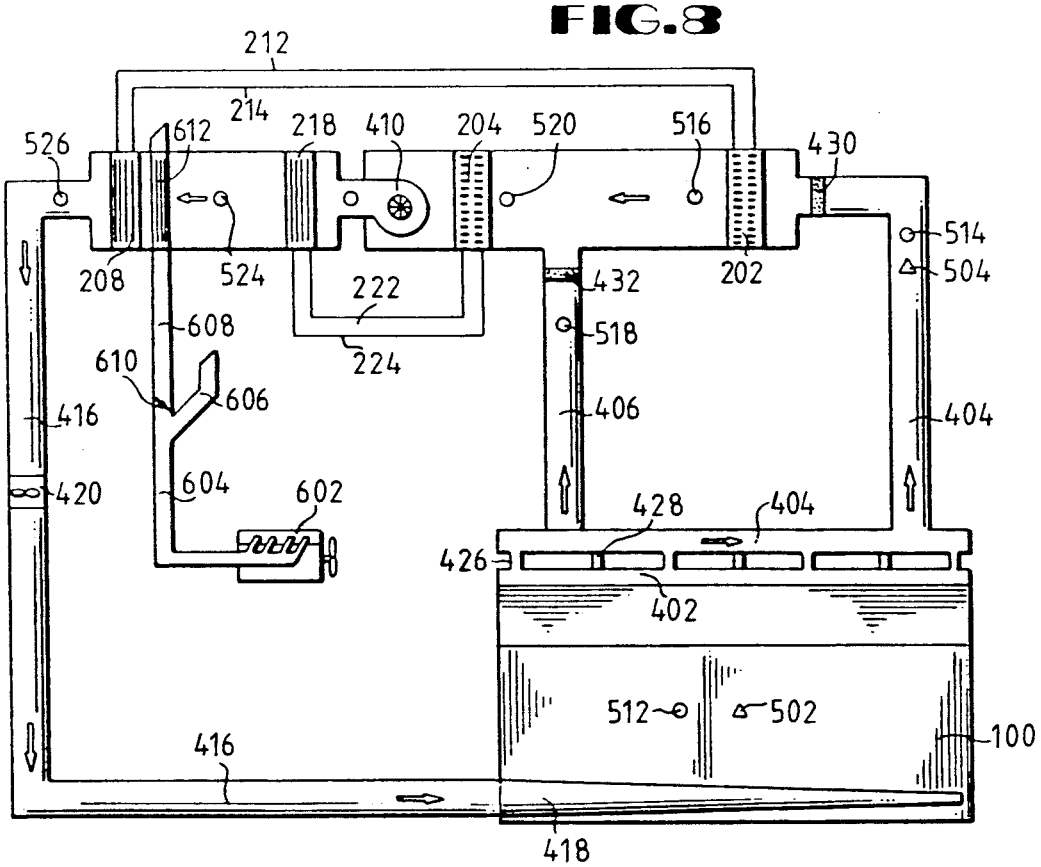
FIG. 8 is a schematic illustration of a second alternative embodiment of the apparatus of the invention, configured as a self-contained mobile unit.

The apparatus of the invention may also be readily constructed as a mobile dehydration unit mounted on, e.g., a flat bed trailer for transportation to and use at a site remote from any source of electrical power. In such a second alternative embodiment, schematically illustrated in FIG. 8, power for operation of the apparatus is derived from a diesel or gasoline engine 602, which may drive the refrigeration units directly or may drive an electrical generator with sufficient output capacity to drive the refrigeration units with electric motors. In this alternative embodiment it is preferred that the condensing coils of the refrigeration units be used as continuous heat sources, for maximum efficiency of operation, with additional heat reclaimed from the engine waste heat used to supply the controllable heat provided by heat source 308 of the preferred embodiment. Hot exhaust gasses from engine 602 flow through exhaust pipe 604, which splits into outlet leg 606 and heat exchange leg 608, with the flow of gasses controlled by valve 610. Heat exchange leg 608 extends though heating section plenum 414, where heat is transferred to the drying fluid as it passes over heat exchanger 612.

In its preferred embodiment, designed to be practiced with the use of the apparatus described above, the process of the invention is a batch process, in which the drying enclosure of the apparatus of the invention is loaded with a quantity of materials to be dried, operation of the apparatus is initiated and continued until the materials have reached the desired conditions of dehydration, whereupon operation of the apparatus is ceased and the dried materials are removed from the drying enclosure. The general steps of the process of the invention are the same regardless of the material to be dried, with the apparatus of the invention being controlled to provide the specific process conditions required for optimum performance. The initial steps of the process comprise the following, described in terms of the preferred embodiment of the apparatus: 1. placing a load of materials to be dried in the drying enclosure, 2. sealing the drying enclosure against ingress or egress of air during the operation of the apparatus, 3. activating all heating sources to begin raising the temperature of the circulating drying fluid, and 4. activating the main blower to begin the circulation of drying fluid through the process loop of the defined by the apparatus. In the preferred embodiment of the process the drying fluid is air, though other gasses may be used if desired. For example, nitrogen may be used as the drying fluid, especially in process applications in which the materials to be dried are particularly susceptible to chemical oxidation.

As the air present in the closed process loop of the apparatus is initially circulated, the temperature of the circulating air is raised toward the value at which moisture is evaporated from the materials to be dried. As the desired temperature of the circulating air is approached the first and second stage refrigeration units are activated to reduce the temperature of the cooling coils over which the circulating air passes and begin removing moisture from the air. When the temperatures monitored by the sensors of the monitoring and control system rise above the minimum temperatures controllable by the control system all automatic controls of the monitoring and control system are activated and tuning of the operation of the apparatus is achieved.

As noted above in the description of the apparatus of the invention, temperatures and relative humidities at the disclosed locations in the process loop may be closely monitored, and operation of the apparatus may be controlled by varying the flow of air through the process loop and by varying the amount of heat added to the circulating air in the heating section of the apparatus. By controlling those primary variables the process conditions determined to be most favorable for efficient dehydration of various materials may be achieved and maintained. It is also possible to alter the process conditions during the progress of dehydration in order to maximize the efficiency of dehydration and/or to optimize the quality of the resulting product.

It has been found that the apparatus of the invention and the process of the invention are particularly useful for drying flowers and other delicate plant materials. If the temperatures used to dry flowers are allowed to rise above the optimum range, which has been found to be generally in the range of 140 degrees F. to 160 degrees F., cellular breakdown occurs, with rapid degradation of the flower parts. However, if the temperatures fall below the optimum range, chemical oxidation and biological degradation of the flower parts occurs. With the two stage condensation of moisture evaporated from the flower parts achieved in the cooling section of the apparatus, rapid drying of the flowers can readily be achieved while process temperatures are maintained within a variation of approximately 2 degrees F. above or below optimum through intermittant operation of the controllable heat source of the apparatus. It has further been found that turbulent air flow through the drying enclosure is detrimental to the final quality of dried flowers, so the flow of air though the drying enclosure toward the ceiling should be as nearly laminar as possible. The construction of the apparatus of the invention, and the ability to control the flow of air through the process loop, allows a laminar flow of air during the practice of the process of the invention to be maintained.

The apparatus and the process of the invention have also been found to be particularly well suited to the dehydration of fruits, vegetables, and other food products, which are also susceptible to both chemical and biological degradation if process conditions are not controlled within suitable ranges of variation from optimum.

The foregoing descriptions of the apparatus of the invention and of the process of the invention are illustrative and not for purposes of limitation. Although various alternative embodiments have been disclosed, the apparatus and the process are susceptible to various other modifications and alternative embodiments without departing from the scope and spirit of the invention as claimed.

What is claimed is:

1. A dehydration apparatus for the dehydration of organic materials by circulation of a drying fluid, comprising a drying enclosure to receive and contain materials to be dehydrated, having a substantially planar base, a pair of opposed side walls with lower edges and upper edges, interconnected at their lower edges to said base in air tight relation, a pair of opposed end walls with lower edges and upper edges, interconnected at their lower edges to said base in air tight relation and interconnected to said side walls in air tight relation, a peaked roof with two sloped portions, interconnected to said side walls and to said end walls in air tight relation with said sloped portions inclined upwardly from said side walls to the peak of said roof, said drying enclosure further having a sealable door means for the purpose of providing access to the interior of said drying enclosure from the exterior thereof;

a cooling section having a first stage cooling coil to cool and condense moisture from drying fluid passed over said first stage cooling coil, a second stage cooling coil to cool and condense moisture from drying fluid passed over said second stage cooling coil, collection means for collecting moisture condensed from said drying fluid, and conduit means for conveying condensed from said cooling section;

a heating section having a first stage heating source to add heat to drying fluid passed over said first stage heating source, thereby raising the temperature and reducing the relative humidity of the drying fluid, and a second stage heating source to add heat to drying fluid passed over said first stage heating source, thereby raising the temperature and reducing the relative humidity of the drying fluid;

a drying fluid handling system having a collection duct disposed at the peak of said roof of said drying enclosure to receive drying fluid from said drying enclosure, a cooling section plenum surrounding said first stage cooling coil and said second stage cooling coil, a first stage return air duct interconnected between said collection duct and said cooling section plenum to convey a first portion of drying fluid from said collection duct to said cooling section plenum to be passed over said first stage cooling coil, a second stage return air duct interconnected between said collection duct and said cooling section plenum to convey a second portion of drying fluid from said collection duct to said cooling section plenum to be introduced thereto between said first stage cooling coil and said second stage cooling coil, a heating section plenum surrounding said first stage heat source and said second stage heat source, an inter-sectional duct interconnected between said cooling section plenum and said heating section plenum to convey drying fluid therebetween, a blower unit disposed in said cooling section plenum to force drying fluid from said cooling section plenum through said inter-sectional duct, a pair of drying enclosure supply ducts each interconnected to one of said side walls of said drying enclosure so as to form a passageway from the interior of the drying enclosure supply duct to the interior of said drying enclosure, and a heated fluid duct interconnected between said heating section plenum and said drying enclosure supply ducts to convey drying fluid from said heating section plenum to said drying enclosure supply ducts; and monitoring and control means for the purpose of monitoring drying fluid temperature and relative humidity at selected positions within said drying enclosure and said drying fluid handling system and controlling the operation of said first and second stage heating sources and of said blower fan.

2. A process of dehydrating organic materials in a dehydration apparatus having a drying enclosure to contain the materials to be dried, a cooling section with a first stage cooling coil and a second stage cooling coil, a heating section with a first stage heating source and a second stage heating source, a closed drying fluid handling system for conveying drying fluid from the drying enclosure through the cooling section, through the heating section, and from the heating section to the drying enclosure, and a blower for circulating air through the apparatus, comprising the steps of placing materials to be dehydrated in the drying enclosure of the apparatus and sealing the drying enclosure against ingress or egress of air;

activating the first and second stage heating sources to heat air contained therein;

activating the blower to circulate air in a closed flow loop through the apparatus;

drawing heated air through the drying enclosure and over the materials to be dehydrated to evaporate and absorb moisture from said materials;

passing a first portion of said air from the drying enclosure of the first stage cooling coil to condense and remove moisture therefrom;

mixing a second portion of said air from the drying enclosure with said first portion of air and passing the mixture of first and second portions of air over the second stage cooling coil to condense and remove additional moisture therefrom;

passing said mixed air over the first stage heating source to raise the temperature and reduce the relative humidity of said air;

monitoring the temperature of said air exiting from said first stage heating source;

passing said air over said second stage heating source while controlling the amount of heat available for transfer from said second stage heating source to said air so as to control the temperature of said air exiting from said second stage heating source within a pre-selected range;

introducing said air to the drying enclosure to be drawn through the drying enclosure and over the material to be dried; and continuing circulation of said air through the apparatus by repeating the recited steps until the moisture content of the material to be dried has been reduced to the desired level.

* * * * *